US005690336A

United States Patent [19]

Oliver

[11] Patent Number: 5,690,336

[45] Date of Patent: Nov. 25, 1997

[54] EDUCATIONAL CARD GAME

[76] Inventor: Matilda Joanne Oliver, 603 E. Independence Ct., Arlington Heights, Ill. 60005

[21] Appl. No.: 756,809

[22] Filed: Nov. 26, 1996

[51] Int. Cl.[6] ..... A63F 1/00; A63F 3/04

[52] U.S. Cl. ..... 273/302; 273/308; 273/430

[58] Field of Search ..... 273/302, 308, 273/236, 242, 243, 249–254, 429–432

[56] References Cited

U.S. PATENT DOCUMENTS

| | | | |
|---|---|---|---|
| 183,335 | 10/1876 | Sitterley . | |
| 506,648 | 10/1893 | McGeorge | 273/302 |
| 791,118 | 5/1905 | Wade . | |
| 1,269,320 | 6/1918 | Scholz | 273/302 |
| 1,273,024 | 7/1918 | Branch . | |
| 1,292,184 | 1/1919 | Wells . | |
| 1,417,434 | 5/1922 | Weiss . | |
| 4,988,108 | 1/1991 | Shepard | 273/254 |
| 5,129,649 | 7/1992 | Scholz | 273/236 |
| 5,141,235 | 8/1992 | Hernandez | 273/308 |

*Primary Examiner*—Benjamin H. Layno
*Attorney, Agent, or Firm*—Emrich & Dithmar

[57] ABSTRACT

An educational game relates to the identification of minor political and geographical areas within a major political and geographical area. The game includes a map representing minor political and geographical areas within the major political and geographical area, a master deck containing minor political boundary cards, boundary border cards, fresh water cards within the major political and geographical area, air border cards, and quiz cards, a sub-division deck containing cards presenting facts relating to minor political and geographical areas within the major political and geographical area, a capitol deck containing capitol cards for each minor political area, and a quiz point deck, with each quiz card presenting a questions that relate to the minor political and geographical areas. The game presents various stages of difficulty and applies to states within a country or to countries within a continent.

25 Claims, 8 Drawing Sheets

EDUCATIONAL CARD GAME

BACKGROUND OF THE INVENTION

The present invention relates to an entertainment, educational, and geographical game utilizing playing cards and maps.

Games utilizing playing cards, either alone, or together with other apparatus, such as maps, have been developed to entertain the participants and to contribute to the participant's education in the field of geography. However, these prior art games generally attempt to teach too many and too complicated geographical facts to the participant. Accordingly, such games are difficult for youngsters and for many adults who really never learned the general location of political or geographical areas with respect to their neighboring political and geographical areas. Also, such complicated geographical facts fail to teach the participant's in the game how major waterways, such as, rivers, lakes, oceans, and gulfs determine the borders of the political and geographical areas. Additionally, some games simulate well known card games such as rummy and bridge with geographical facts being recorded on the card faces. However such a game depends upon the players ability to read and to learn geography as they concentrate on winning the rummy or bridge game. Accordingly, such games do not reward knowledge for knowing the geographical facts and their geographical areas towards winning the game.

One such prior art game is described in Wade U.S. Pat. No. 791,118. This game utilizes political and geographical facts and area locations. The Leading cards, representing the main geographical and political areas, are played when they correctly form one of the borders with the previously played Leading card. River and ocean cards, called "Switch" cards, are provided and represent a political division boundary. The "Switch" cards are wild cards and may be played when the player has no playable Leading card. Following the "Switch" card play, only a "Leading" card that borders the Switch card, or if no Leading card is held, another Switch card held by the player may be played. In all plays where a hand-held card cannot be played, a card from the undealt deck must be added to the player's hand until a playable card appears. A single wild card, a "Capitol" card, may be played when there is no Leading card available and any other card may be played on a previously played Capitol card. However, in the attempt to prevent blocking of the game, the use of the "Switch" card as a wild card loses its teaching value to the player. Also, in the Wade game, the players must be knowledgeable about the locations of the areas represented by the Leading cards to play the game and means is provided in the game to educate the young and beginning player of the area locations. Thus, such a game is not an educational game for the uninformed and beginning player. Additionally, political and geographical facts are printed on each of the Leading cards, these facts are used only in the game when the player who has only one card left in his hand and is about to end the game. At this point in the game, the other players are permitted to quiz the prospective winner about any of the facts printed on the Leading card. However, it is possible for a player holding more than one card to end the game if he is holding cards that can be played on one another, thus avoiding the need to answer or learn any facts. Finally, many of the facts printed on each playing card are far too difficult and are relatively unimportant to memorize, especially for beginner's and youngsters, such as square miles occupied by each state, the length of rivers, and the width of the oceans.

In McGeorge et.al. U.S. Pat. No. 506,648, the political divisions (states) have the names of their political or geographical boundaries printed in the margins of the rectangular cards. This permits the cards to be placed next to each other to simulate, in a loose map-like manner, what political divisions border on each other. Also, each state card is also imprinted with the identical type of political and geographical facts concerning the particular state, for example, the capitol city, the population, and the area. Thus, only a small portion of the game is related to the education concerning the boundaries of the states. Also, there are no cards representing waterways or foreign national boundaries and when playing the game, there are no incentives to memorize or learn either the boundaries of the states or the facts related to the states.

Finally, Wells U.S. Pat. No. 1,292,184 and Branch U.S. Pat. No. 1,273,024 disclose card games related to the locations of related political division areas. However, the skill in winning is not dependent upon learning the locations and neighboring political divisions. Instead, these card games rely upon collecting cards having similar suits or codes printed thereon, as well as containing political and geographical information. Thus, these games are similar to conventional card games and do not provide an educational tool for entertainment and for learning political and geographical areas.

SUMMARY OF THE INVENTION

One object of the present invention is to provide an educational game utilizing playing cards and maps which teaches the player the locations, boundaries, and borders of political and geographical areas with respect to neighboring political and geographical areas.

Another object of the present invention is to provide a game which teaches a player having varied knowledge the relationship between minor political and geographical areas with respect to neighboring major political and geographical areas.

Still a further object of the present invention is to educate the player as to how the geological areas, such as lakes, rivers, oceans, and ocean-like waterways are natural borders for fixing the boundaries of political and geographic areas.

It is still another object of the present invention to teach the player geological, geographical, and political facts, relating to the political and geographical areas addressed by the game during playing of the game.

Additionally, a further object of the present invention is an educational game that has application to any major geographical area that may be subdivided into a plurality of defined minor political sub-divisions or states.

Also, another object of the present invention is an educational game that has application to major geographical areas or continents that are subdivided into a plurality of minor political sub-divisions or countries.

Finally, an object of the present invention is a game which educates the players about the political and geographical areas, either single countries or continents, during the playing of the game in a progressive manner by providing game apparatus for the various levels of the player's knowledge of geography and the states or countries within the area or continent by dividing the game into three stages of difficulty beginning with novice players and increasing to proficient players.

The present invention is directed towards educating a player to the locations of similar or related minor political areas within a primary major political or geographical area with reference to neighboring political or geographical areas, oceans, ocean-like areas, designated fixed areas, waterways that form natural borders, and neighboring border political areas as related to the primary major political or geographical areas. A secondary goal of the present invention is the teaching of geological, political, and geographical facts to the player that are associated with the primary political and geographical areas, with the geographical area being any area or country that may be sub-divided into a plurality of defined political sub-divisions or states or being any continent or area that may be sub-divided into a plurality of political sub-divisions or countries.

The invention consists of certain novel features and structural details hereinafter fully described, illustrated in the accompanying drawings, and particularly pointed out in the appended claims, it being understood that various changes in the details may be made without departing from the spirit or sacrificing any of the advantages of the present invention.

DESCRIPTION OF THE DRAWINGS

For the purposes of facilitating and understanding the present invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF THE PREFERRED EMBODIMENT

Figure 1:
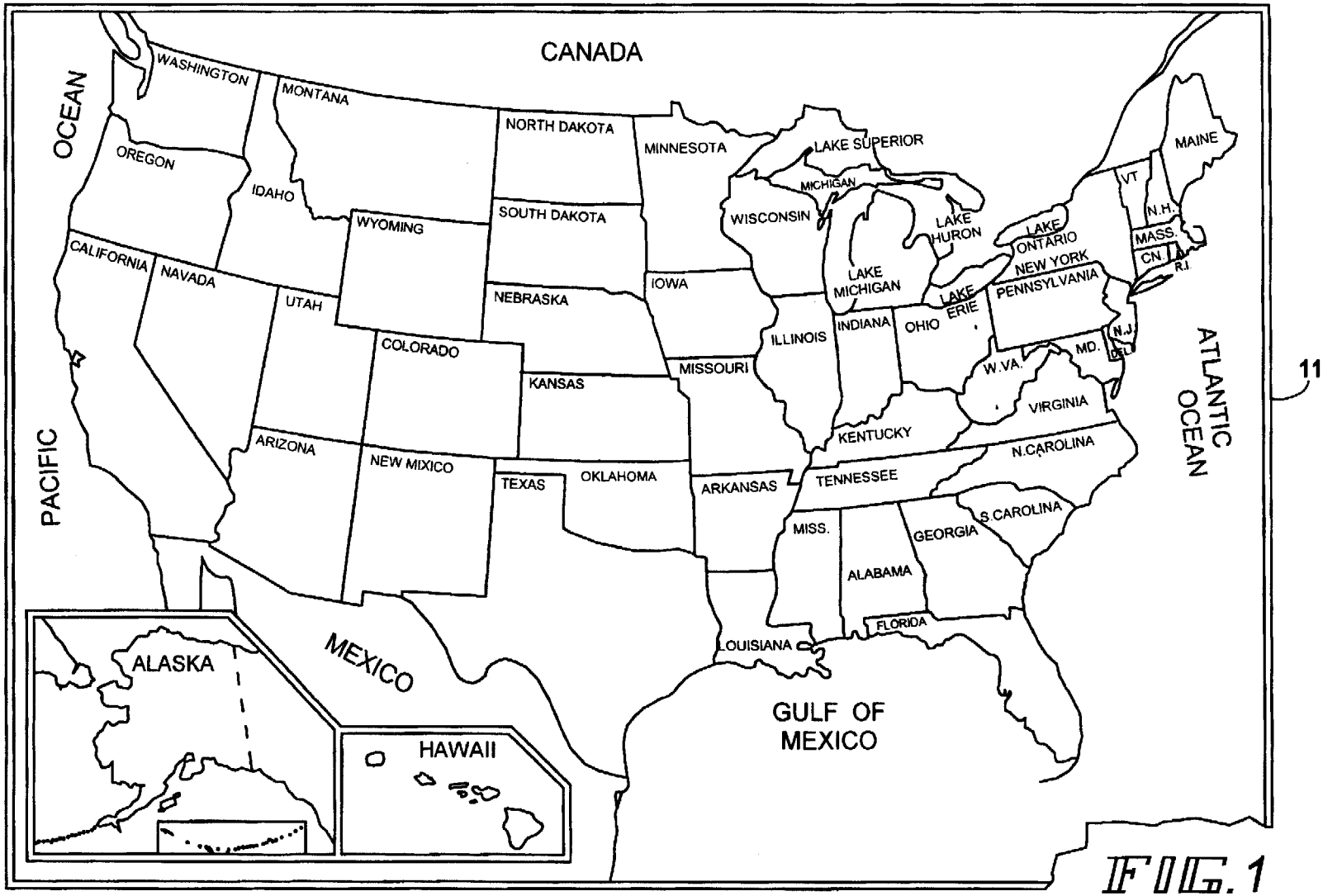
FIG. 1, is a pictorial map of the United States and its borders.

Referring now to the drawings wherein like numbers have been used throughout the several views to identify the same or similar parts, the educational game in accordance with the present invention, preferably, includes a geographical and political area map 11 selected to represent, for example, a portion of North America. As shown in FIG. 1, the primary or minor geographical and political area map 11 illustrates the 50 states of the United States, the five Great Lakes, the ocean borders, and border countries.

The educational game in accordance with the present invention may be divided into several stages of difficulty depending on whether none, some, or all the supplemental decks are used with the master geographical and political area card deck. The simplest beginner's or novice's game is for inexperienced and unknowledgable players utilizes a map of the political and geographical area and a master deck 12 of minor political and geographical areas (FIGS. 2A, 3A, 4A, and 5A). The intermediate game is for players having some knowledge of geographical and political areas and utilizes a master deck 14 of geographical and political areas (FIGS. 2B, 3B, 4B, and 5B). The complex game or advanced is for experienced and knowledgeable players and utilizes a master deck 16 of geographical and political areas (FIGS. 2C, 3C, 4C, and 5C). All three games are played in the same manner. However, the amount of pertinent geographical and political information available to the players from the map and the playing cards is greatest for the beginner's game, less available for the intermediate game, and least available for the complex or advanced game.

The geographical and political information included in the master decks 12, 14, and 16 includes the geographical locations of the states with reference to other states, the location of states with respect to the Great Lakes and other bodies of water, and the location of states with respect to adjacent foreign countries. Knowledge of such information is necessary for the player to have a chance at winning the game at whatever level of difficulty the game is played. Other information of importance in winning the game are geographical and political facts about the 50 states; such as their capitol and history concerning the formation of the United States. Each of the three games requires four decks of playing cards with the intermediate and advanced games each using two decks of challenger cards.

The simplest or beginner's game in accordance with the present invention utilizes the geographical and political map 11 of FIG. 1 as one of its main teaching tools. The map 11 contains some of the political and geographical information that a player must know to successfully compete in either the simplest or beginner's game, the intermediate game, and the advanced game.

Master decks 12, 14, and 16 are provided and each deck, for example, may contain 90 playing cards. Each deck may be comprised of 55 cards representing the 50 states and, if desired, the five Great Lakes, 25 cards representing the oceans, the Gulf of Mexico, foreign countries, and air borders, and 10 cards representing quiz cards, as will hereinafter be described.

Figure 2A:
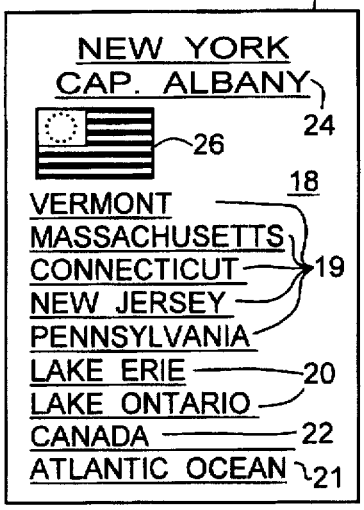
FIG. 2A, 2B, and 2C, respectively are front views of a state boundary playing card in accordance with the present invention representing one of the original 13 states for the three increasing stages of difficulty in playing the game.
Figure 2B:
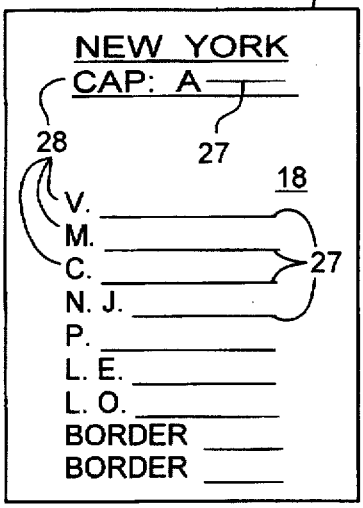
Figure 2C:
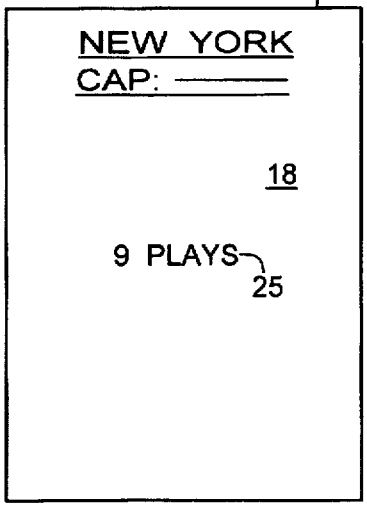

Specifically, 50 of the playing cards from each of the three master decks 12, 14, and 16 are state boundary cards 18, as shown in FIGS. 2A–2C. Of the 50 state boundary playing cards 18, 13 cards may, for example, represent the original 13 states or colonies that formed the United States. As shown in FIG. 2A, the front of a state boundary card 18 for the state of New York is illustrated for use with the master deck 12 for the simplest game. The minor or state boundary card 18 for use in the beginner's game includes detailed information thereon, such as the identification of each of the boundary states of Vermont, Massachusetts, Connecticut, New Jersey and Pennsylvania (identified as 19), if desired, the identification of the boundary Great Lakes of Erie and Ontario (identified as 20), the identification of the border ocean Atlantic (identified as 21), the identification of the border foreign country of Canada (identified as 22), and the identification of the particular state's capital city of Albany (identified as 24). Also, included on the state boundary card 18 may be other facts such as the order that the particular state was admitted to the Union, if desired. Also, the minor or state boundary card 18, in the case of the 13 original states or colonies, preferably, will contain a designation or indicia 26 thereon to designate that the particular boundary card is one of the original thirteen colonies.

The master deck 14 for use with the intermediate game is illustrated, for example, in FIG. 2B as the state of New York boundary card 18. This state boundary card 18 includes ten single letter hints or abbreviations 28 followed by ten spacings 27 which spacings represent the state capitol 24, the five boundary states 19, the two boundary Great Lakes 20, the border foreign country 22, and the border ocean 21. Thus, the master deck 14 for the intermediate game, as shown in FIG. 2B, includes a designated amount of information to be known and learned by the intermediate player and to assist that player in successfully playing the educational card game.

FIG. 2C shows the state of New York boundary card 18 for use in playing the complex or advanced game. The advanced state boundary card 18, contains one spacing 27 proceeded by the abbreviation 28 for the word Capitol followed by the statement "9 Plays" 25 which indicates the sum of the number of boundary states 19, the number of Great Lakes boundaries 20, the number of foreign borders countries 22, and the number of border oceans 21 relating to the particular state boundary card in play, which information must be supplied by the player of the advanced game. The minor or state boundary cards 18 for states other than one of the original 13 states or colonies may be made in the same manner except that the original state or colony designation 26 and the order that the state was admitted to the United States is not shown.

Figure 3A:
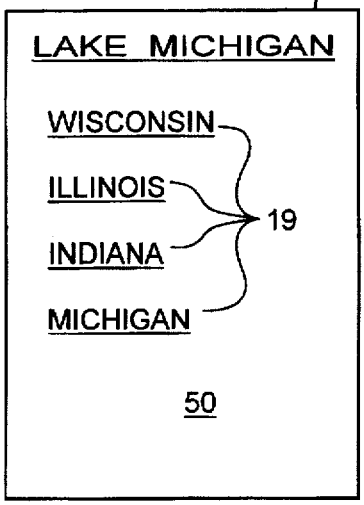
FIG. 3A, 3B, and 3C, respectively are front views of a boundary playing card in accordance with the present invention for the three decks of increasing stages of difficulty in playing the game.
Figure 3B:
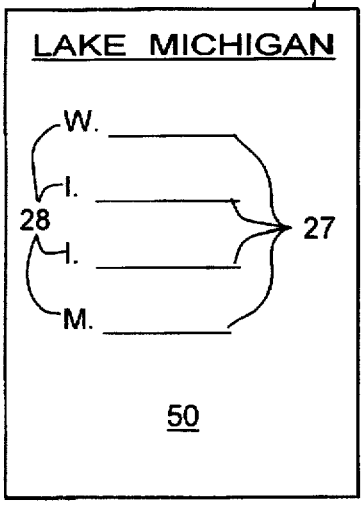
Figure 3C:
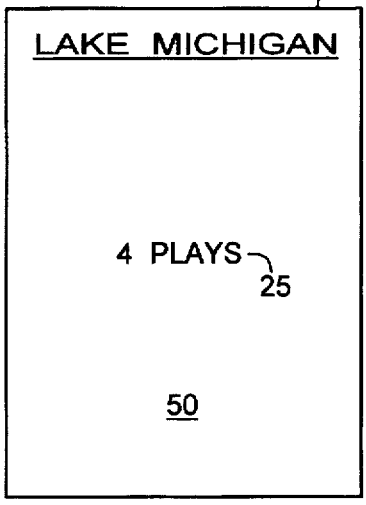

In FIG. 3A when Great Lakes boundary cards are utilized in the master deck, the face of one of the five Great Lakes boundary cards 50, for example Lake Michigan, is depicted with its boundary states 19 of Wisconsin, Illinois, Indiana, and Michigan being identified thereon. Thus, FIG. 3A illustrates the Great Lakes boundary card 50 which may be used in playing the beginner's game utilizing the master deck 12. FIG. 3B shows Great Lakes border card 50 of the master deck 14 for use in playing the intermediate game. This border card 50 contains four hints or abbreviations 28 followed by spacings 27 which represent the four states that border Lake Michigan. FIG. 3C shows the Great Lakes boundary card 50 for deck 16 which is used in playing the advanced game. The boundary card 50 indicates "4 Plays." The boundary cards for the other Great Lakes if they are included in the master decks 12, 14, and 16 are similar to the cards described above.

Two foreign countries account for six additional border country cards 60 of the 90 cards in each of the master decks 12, 14, and 16-five cards for Canada and one card for Mexico. Border country cards 60 are similar to the state boundary cards 18 and are played in a similar manner to that of the state boundary cards. However, the border country cards 60 do not include a capital city on their face and, therefore, they may not be played from a player's hand using a capitol card 41 and using an original 13 states card 26 because the border country is not a state. These two limitations when using master decks 14 and 16 will be hereinafter described.

Figure 5A:
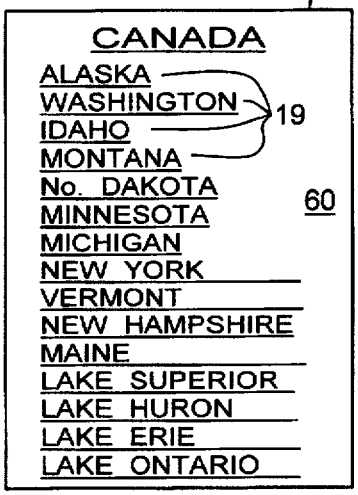
FIGS. 5A, 5B, and 5C, respectively, are front views of a foreign country border card in accordance with the present invention for the three increasing stages of game difficulty.
Figure 5B:
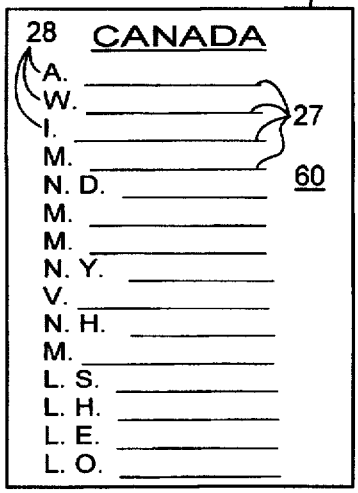
Figure 5C:
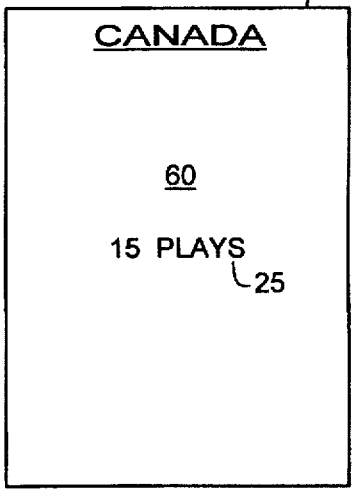
Figure 15A:
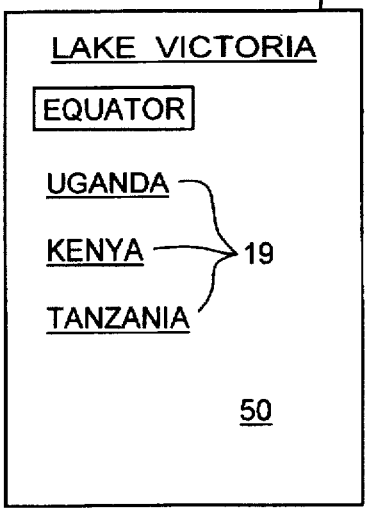
FIGS. 15A, 15B, and 15C, respectively, are front views of a boundary playing card in accordance with the present invention for the three decks of increasing stages of difficulty in playing the game.
Figure 15B:
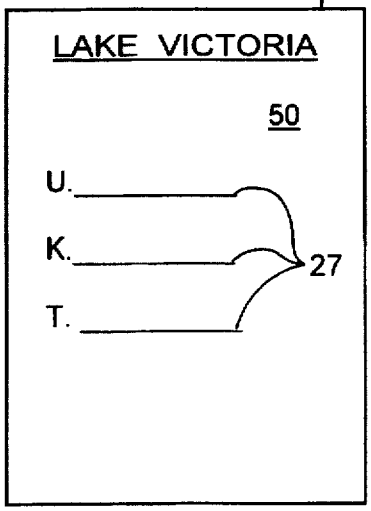

FIGS. 5A, 5B, and 5C, respectively illustrate, for example, the border boundary cards 60 for Canada for master decks 12, 14, and 16 in the order of increasing difficulty in playing the educational game in accordance with the present invention. In FIGS. 5A, the border country cards 60 include designated boundary States 19 and, if necessary, the boundary Great Lakes 20. In FIG. 5B, 15 spacings 27 and abbreviations 28 are provided and in FIG. 5C, the number of plays 25, is identified. The border country card for Mexico follows the same pattern as Canada.

Figure 4A:
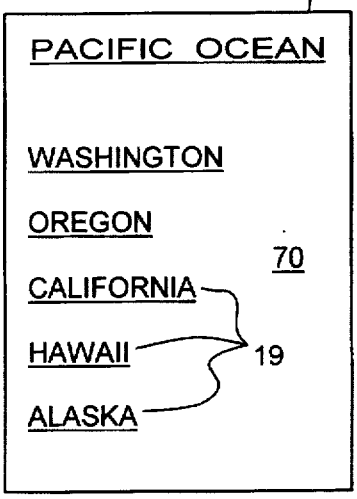
FIGS. 4A, 4B, and 4C, respectively, are front views of an ocean border card in accordance with the present invention for the three increasing stages of game difficulty.
Figure 4B:
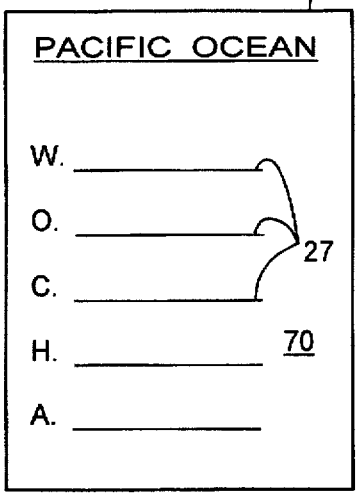
Figure 4C:
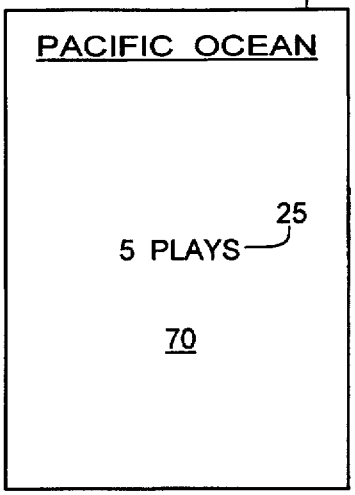

Border ocean cards 70 account for ten cards of the 90 playing cards in master decks 12, 14, and 16. Three border cards 70 are provided for the Pacific Ocean, six border cards 70 for the Atlantic Ocean, and one border card for the Gulf of Mexico. Again, FIGS. 4A, 4B, and 4C illustrate, an ocean border card 70 for the Pacific Ocean for each of the master decks 12, 14, and 16 in order of their increasing difficulty in playing the educational game of the present invention. The ocean border playing cards 70 for the Atlantic Ocean and for the Gulf of Mexico follow the same pattern as the Pacific Ocean border cards. It should be noted in reference to FIGS. 5A–5C, that the two border boundary playing cards, the main difference in playing such cards in the game is that a border card may not be played on another border card.

Figure 6:
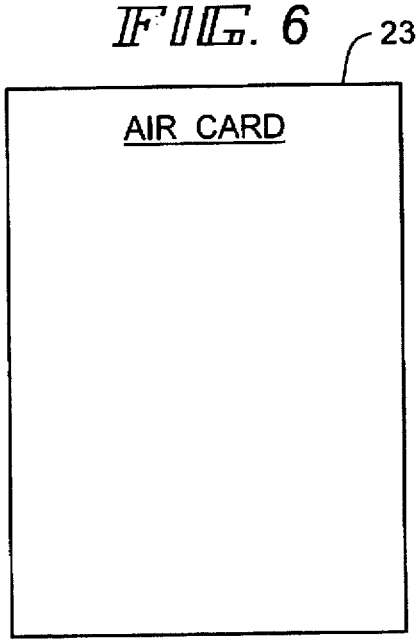
FIG. 6 is a front view of an air border card in accordance with the present invention.

Nine air border cards 23, as shown in FIG. 6, are provided in the 90 card decks that comprise master decks 12, 14, and 16, although the number of air border cards is not critical. The air border cards 23 are of the same design for play in the educational game for the beginner's, intermediate, and complex games. Accordingly, air border cards 23 are played as a limited "wild card", that is the air border card 23 may be played on any boundary card, but because it is a border card it may not be played on another border card.

Figure 7:
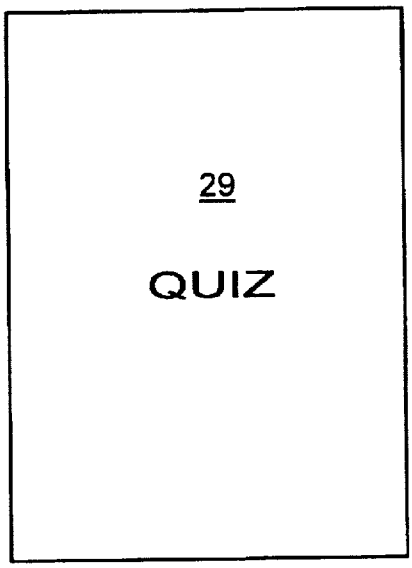
FIG. 7 is a front view of a quiz card in accordance with the present invention.
Figure 8:
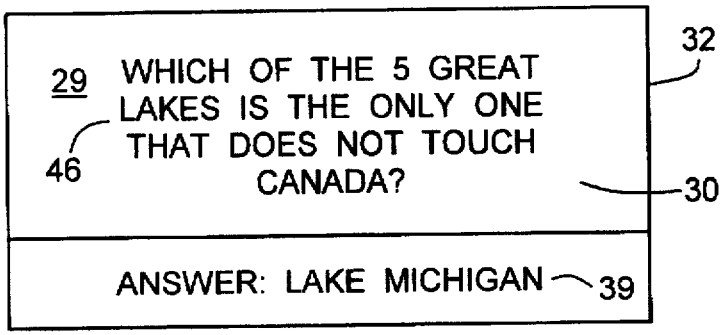
FIG. 8 is a front view of a quiz point card in accordance with the present invention.

Quiz cards 29, are illustrated in FIG. 7 and, preferably, account for ten of the 90 cards that comprise master decks 12, 14, and 16. All quiz cards 29 have the same design for each of the levels of play of the educational game. The play of a quiz card entitles the player to choose and answer one of the quiz point cards 30, as shown in FIG. 8, from the quiz point deck 32 which may contain at least 50 quiz point cards, as desired.

Figure 10:
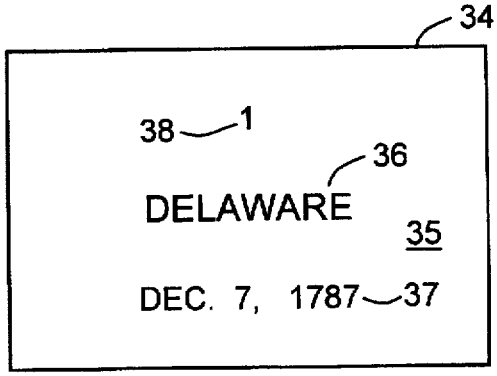
FIG. 10 is the front view of an original thirteen states card in accordance with the present invention.

A sub-division or colony deck 34, for example, may be, a thirteen card deck comprised of colony deck cards 35, each card representing one of the original states of the United States of America, as shown in FIG. 10. The sub-division deck may be any desired sub-division of facts relating to a predetermined political and geographical area within a major area that is desired. For example, it may be the states contacting the Mississippi River, the original colonies, or any other desired collection of related minor political and geographical areas with the major political and geographical area. The sub-division or colony deck may be played in conjunction with one of the 13 original state boundary cards 18 from master decks 12, 14, and 16, during play of the educational game. FIG. 10 illustrates the face side of the Delaware colony deck card 35, identifying the state 36, its date 37 of entering the United States of America, and its order 38 in entering the United States. The remaining twelve colony deck cards 34 representing the remaining colonies follow the same pattern as that for Delaware. It should be noted that a sub-division deck is not critical to playing the educational game in accordance with the present invention; however the sub-division may be included to provide special and enhanced education to the game.

Figure 9:
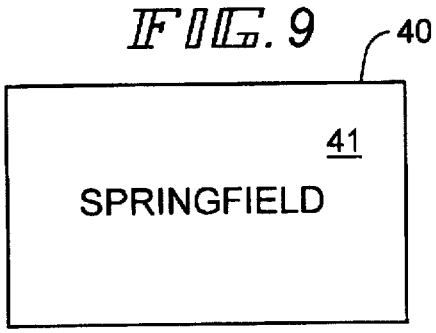
FIG. 9 is a front view of a capitol card in accordance with the present invention.

A capitol card 40 deck is provided and consists of 50 cards, each naming the capitol city of one of the 50 states in the master deck 12, 14, and 16. FIG. 9 shows one of these capitol deck cards 40 which represents the state of Illinois, identifying Springfield as the capitol.

Figure 11:
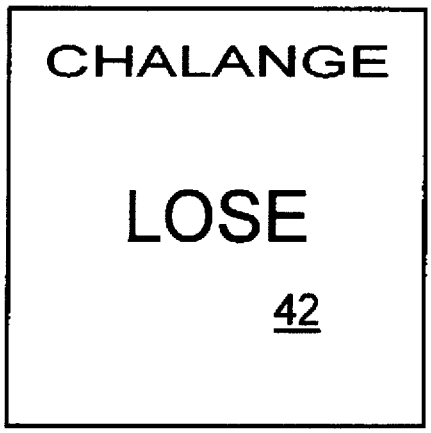
FIG. 11 is a front view of a loser challenger card in accordance with the present invention.
Figure 12:
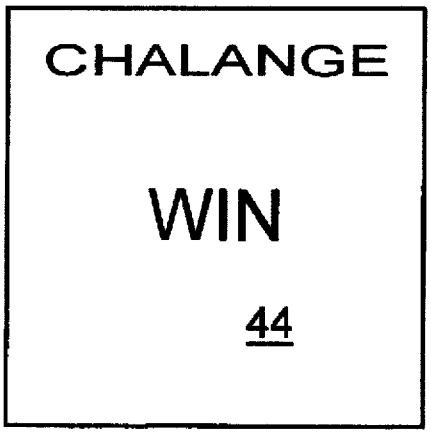
FIG. 12 is a front view of a win challenger card in accordance with the present invention.

FIGS. 11 and 12 illustrates challenge lose decks 42 and challenge win decks 44 which are used with the master deck 14 for the intermediate game and the master deck 16 for the advanced game. The challenge decks 42 and 44 allow other players of the game to challenge the play made by a player and to earn points if they correctly challenge a play and to lose points if they incorrectly challenged a play. Preferably, the player who played the last card before the challenge may receive or lose the points 43 involved in the outcome of the challenge.

Figure 13:
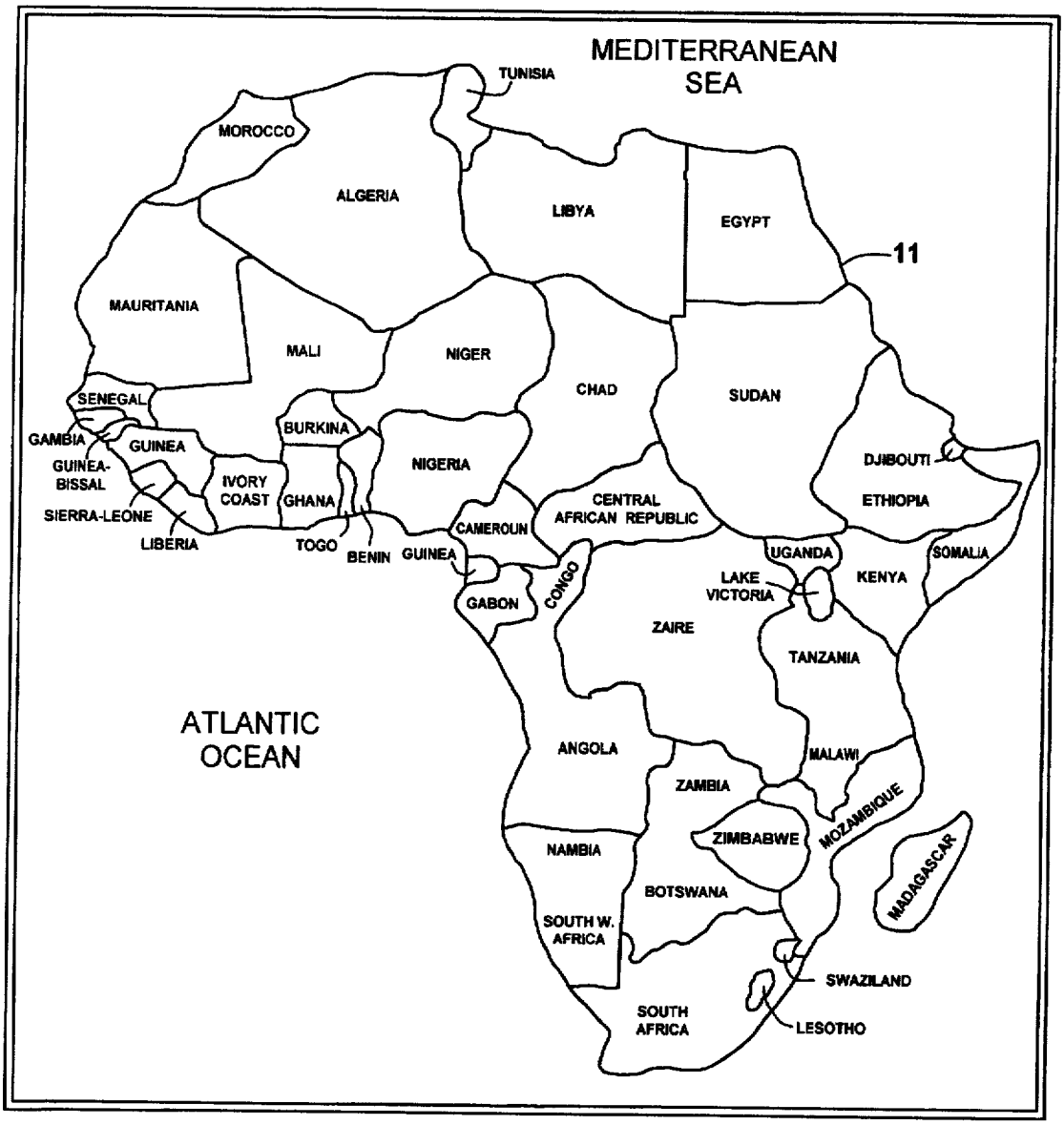
FIG. 13 is a pictorial map of the African Continent and its borders in accordance with a further embodiment of the present invention.

In accordance with a further embodiment of the present invention, a geographical and political area map 11 selected to represent, for example, the African continent is shown in FIG. 13. As shown in FIG. 13, the primary geographical and political area map 11 illustrates the 53 countries of Africa, Lake Victoria, if desired, and the ocean borders.

Figure 15C:
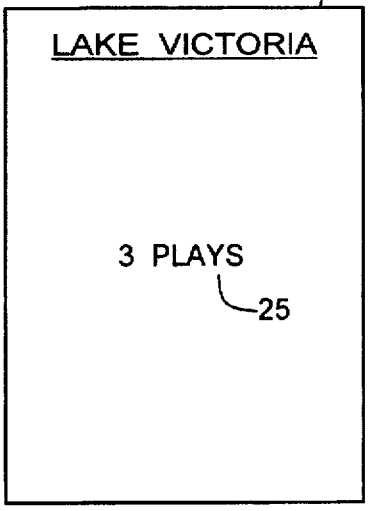
Figure 16A:
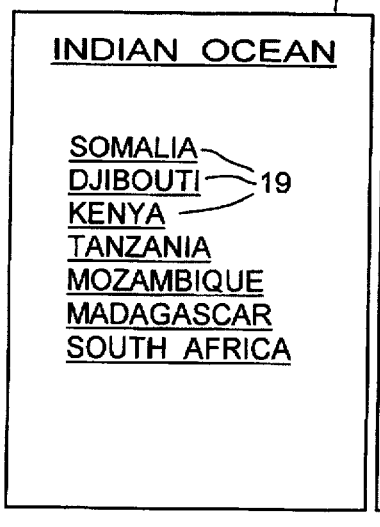
FIGS. 16A, 16B, and 16C, respectively, are front views of an ocean border card in accordance with one embodiment of the invention for the three increasing stages of game difficulty.
Figure 16B:
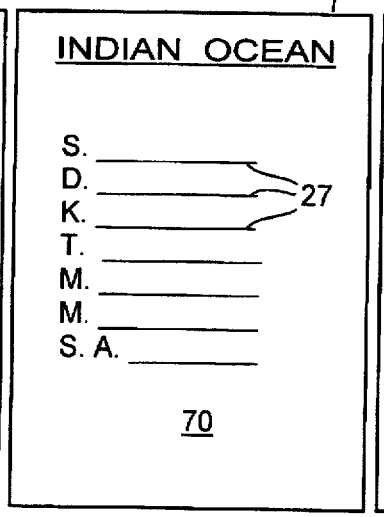
Figure 16C:
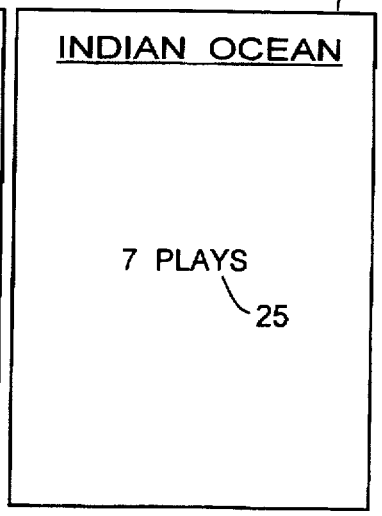

As set forth above, the educational game in accordance with this embodiment of the present invention may be divided into several stages of difficulty depending on whether some or all the supplemental decks are used with the geographical and political area card deck. The simplest or beginner's or novice's game utilizes a master deck 12 of political and geographical areas (FIGS. 14A, 15A, and 16A), the intermediate game for players utilizes a master deck 14 of geographical and political areas (FIGS. 14B, 15B and 16B), and the advanced game utilizes a master deck 16 of geographical and political areas (FIGS. 14C, 15C, and 16C). Again all three games are played in the same manner; however, the amount of pertinent geographical and political information available to the players from the map and the playing cards is greatest for the beginner's game, less available for the intermediate game, and least available for the advanced game.

The geographical and political information included in the master decks 12, 14, and 16 includes the geographical locations of the countries with reference to other countries, if desired, the location of countries with respect to Lake Victoria and to the oceans and seas. As is true of the first embodiment of the present invention, knowledge of such information is necessary for the player to have a chance at winning the game at whatever level of difficulty the game is played. Other information of importance in winning the game of this embodiment are geographical and political facts about the 53 countries; such as their capital, their location with respect to the equator and their language. Each of the three games requires four decks of playing cards with the intermediate and advanced games each using two decks of challenger cards.

The simplest or beginner's game in accordance with this embodiment of the present invention utilizes the geographical and political African map 11 of FIG. 13 as one of its main teaching tools in the beginner's game. The map 11 contains some of the political and geographical information that a player must know to successfully compete in either the simplest or beginner's game, the intermediate game, and the advanced game. Master decks 12, 14, and 16 are provided and each deck contains if desired, 100 or more playing cards. Preferably, each deck is comprised of 54 cards representing the 53 countries and one Lake Victoria card 26, if Lake Victoria, or fresh lake is included within the game, cards representing the oceans and seas and air borders, and 10 cards representing quiz cards, as will hereinafter be described.

Figure 14A:
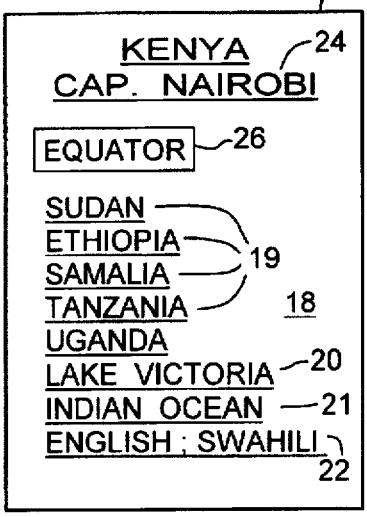
FIGS. 14A, 14B, and 14C, respectively, are front views of a country boundary playing card in accordance with the further embodiment of the present invention representing one of the countries of Africa for the three increasing stages of difficulty in playing the game.
Figure 14B:
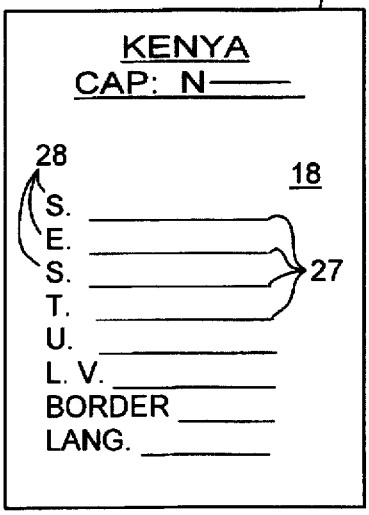
Figure 14C:
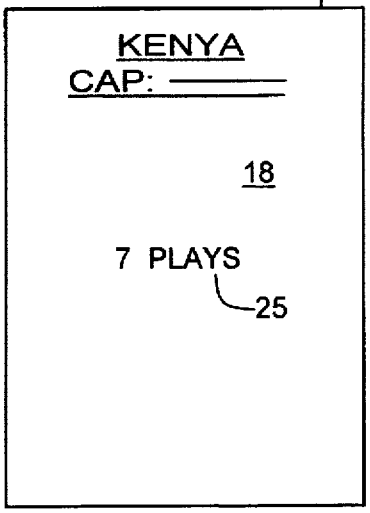

Specifically, 53 of the playing cards from each of the three master decks 12, 14, and 16 are minor country boundary cards 18, as shown in FIGS. 14A–14C. If desired, of the 53 country playing cards 18, six cards represent the countries located on the Equator. As shown in FIG. 14A, the front of the Kenya boundary card 18, is illustrated, for example, for use with the master deck 12 for the simplest game. The Kenya boundary card 18 for use in the beginner's game includes detailed information thereon, such as, for example, the identification of each of the boundary countries of Sudan, Ethiopia, Somalia, Tanzania and Uganda 19, the identification of the boundary Lake Victoria 20, the identification of the border ocean Indian Ocean 21, and the identification of the capital city and the language 22 spoken. Also, if desired, the Kenya boundary card 18 contains a designation or indicia 26, which designates that the particular country is one of the countries located on the Equator.

The master deck 14 for use with the intermediate game is illustrated, in FIG. 14B for the Kenya boundary card 18. This minor country boundary card 18 includes eight single letter hints or abbreviations 28 followed by eight spacings 27, which spacings represent the capitol 24, the five boundary states 19, the one boundary lake 20, and the border ocean 21.

In this embodiment of the invention, border ocean or sea cards 70 account for 37 cards of the 100 or so playing cards in master decks 12, 14, and 16. Twenty border cards 70 are provided for the Atlantic Ocean, eight border cards 70 for the Indian Ocean, four border cards 70 for the Red Sea, and five border cards for the Mediterranean Sea. FIGS. 16A, 16B, and 16C illustrate the Indian ocean border card 70 for each of the master decks 12, 14, and 16 in order of increasing difficulty in playing the educational game of the present invention.

As in the first embodiment, several air border cards 23, as shown in FIG. 6, are provided in the 100 or more card decks that comprises the master decks 12, 14, and 16 and played in the same manner. Also, Quiz cards 29 as illustrated in FIG. 7, account for ten of the 100 or more cards that comprises each of the master decks 12, 14, and 16. All quiz cards 29 have the same design for each of the levels of play of either educational game and the play of a quiz card represents the three border countries. FIG. 15C shows the Lake Victoria boundary card 50 for deck 16 which is used in playing the advanced game. This boundary card 50 indicates "3 Plays."

Figure 17:
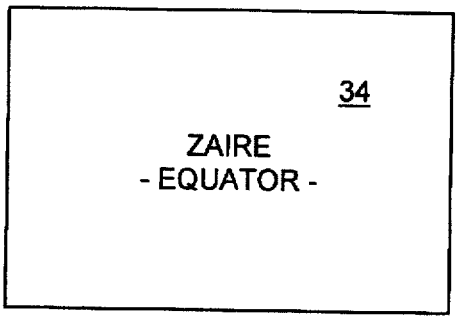
FIG. 17 is the front view of an Equator country and water card in accordance with the present invention.

A sub-division or an Equator deck 34 is a six card deck, each card representing a country or lake located on the Equator, as shown in FIG. 17, with the sub-division deck only identifying each of the countries located on the Equator. The Equator deck may be played in similar fashion as one of the 13 original colony card 34 from master deck 12, 14, and 16, during play of the educational game. FIG. 17 illustrates the face side of the Zaire card 34.

A capitol card 40 deck is provided and consists of 53 cards, each naming the capitol city of one of the 53 countries in the master deck 12, 14, and 16, in the same manner as FIG. 9 identifies such information in the first embodiment. As described above, the country game of this embodiment involves a plurality of master decks, one deck for the novice player, one deck for the intermediate player, and one deck for the advanced player. The deck includes ocean border cards, if desired lake border cards, air border cards and quiz cards. The quiz point decks, capitol decks and challenge card decks are similar in each game, except for the information presented. Thus, the only difference in the use of an equator sub-division deck in place of a colony sub-division deck is that the presented facts relate to a predetermined or minor political and geographical area within the major political and geographical area. This difference is by way of example and should not be a limitation as to the scope of the present invention. For example, in the first embodiment, a sub-division deck, for example, could include all states bordering the Mississippi River. Such a modification to the game is within the scope of the present invention because such modifications enhance the learning for the player of the educational game.

Although there may be fourteen separate games of increasing difficulty in the educational game of the present invention, the method of playing each game is not affected, only the varying degree of information provided by each game including, the map, the hand-held playing cards, the questions presented in the quiz point deck, and the capitol deck.

To play the various games of the present invention, first the deck of capitol cards 40 are shuffled and placed face down between the players. One of the master decks 12, 14, and 16, each containing, preferably, 90 cards comprised of state boundary cards, boundary border cards, air border cards and quiz cards is selected according to the skill and knowledge of the players. The master deck selected is thoroughly shuffled and the dealer inserts the quiz cards 29 randomly or evenly throughout the particular selected master deck. The dealer then begins by dealing seven playing cards from the selected master deck 12, 14, or 16 to each player. The next card is placed face-up between the players, and the remaining cards in the master deck are placed face-down alongside the one face-up card.

The goal of the educational game is to win the game by getting rid of all the hand-held playing cards. The game ends when the first player is out of hand-held cards. Points may be awarded for various card playing tasks performed during the game. However, the players may elect not to use a point system and to decide that the winner is the first player who is out of hand-held cards. However, a point system of scoring does permit other players, who have considerable skill, to have an opportunity of winning the game by building up sufficient points during the game, while holding only a minimum of cards at the end of the game, as desired.

In playing the master deck 12 in conjunction with the map in a beginner's game, the dealer or any other player should remind the players that any time during playing the game, when a state boundary card 18 that is one of the original 13 state cards is held in the hand, one of two choices is available to the player. The first choice is to keep the card in the player's hand with the option of later making a second choice. The second choice is irreversible and includes placing the original state card in front of the player face-up. If this choice of play is selected, the player may also play any other face-up original state card face-up. The advantage of having these cards placed face-up is that it allows the player, at the beginning of his turn, to pick up the top card from the sub-division or colony deck 34. If the colony master deck card 35 picked up matches any of the face-up original state cards, the two matched cards are placed together and removed from play. However, if there is no match, the selected sub-division or colony deck card 35 is replaced at the bottom of the colony deck 34. In the second choice of plays, the player may have an additional opportunity to get rid of a card in each turn and the player may earn points towards winning the game when the face-up card matches a sub-division or colony deck card 34, if a point system for the game is in force. The disadvantage of such play is that a point penalty is assigned to all non-played face-up original state cards 18 when the game ends. A face-up original state card 18 can also be played, at any time, similar to hand held cards.

The first player to the left of the dealer begins the game by inspecting his dealt hand-held cards for any designated original minor state cards 26 and deciding whether or not to keep them hand-held or placed face-up. If the player has at least one designated original state card 26 placed face-up, a card is taken from the top of the sub-division or colony deck 34 and inspected to see if it matches the player's state card 26. As described above, a matched pair is set aside face-up and points will be awarded for this play. If there is no match, the card 35 drawn from deck 34 is returned to the bottom of the sub-division deck.

The first player then takes the top card 41 from the capitol city card deck 40 and inspects it to determine if the city on the selected card matches any of the minor boundary cards 18, including any of those designated minor original cards placed face-up or, held by the player. If the beginner's game is being played, the hand-held minor state boundary card 18 will have the state capitol 24 shown thereon. If the city on the capitol card 41 matches the capitol city on the hand-held boundary card, those two cards are put to the side of the player face-down, and points may be awarded for this play. If there is no match, the capitol card 41 is returned to the bottom of the capitol card deck 40.

Continuing with the game, the first player after finishing with the capitol city play then inspects the one face-up card played by the dealer to see if any boundary or border cards in his hand matches the face-up card. If the dealt face-up card is an air border card 23, any boundary card can be played on an air border card. However, an air border card 23 cannot be played on another air border card because of the restriction prohibiting such play at any time of the game. Also, if the one face-up card from the master deck 12 is a border ocean card 21 and the player does not have a boundary state card 18 bordering the particular ocean, the player may not play an air border card 23 on the border ocean card because both cards are border cards. Thus, in accordance with the present game, a border card cannot be played on another border card. There is one, and only one, exception to this rule which aids in preventing a blockage or tie in ending the game, as will hereinafter be described.

In the beginner's game, the players obtain information from the hand-held cards and the detailed map 11. The players must use this information as learning tools, not just as helpers, if they are to become proficient players for later play of the intermediate and complex games. When there is no matching card to be played in the player's hand, the player must take the top card from the face-down master deck 12 and inspect it to see if it might be a match for the one face-up card. If the card is a match, the card selected may be played on the face-up card. If the selected card is not a match, the selected card must be added to the players hand-held playing cards.

The quiz cards 29 are special in their play in the game because they do not involve the matching of boundaries or border cards. Quiz cards may be used as a play instead of a boundary or border card and can be played during any turn by a player. However, an ideal time to use the quiz card 29 is when the player has no play on the top face-up card of the state boundary deck. When played, the quiz card is put to one side and the player picks one of the cards 30 from the quiz point deck 32. The quiz card player without looking at the card 30, gives it to another player who reads the question. The quiz card player then tries to answer the question. If the correct answer is given, the quiz point card 30 is given to the player for keeping with the quiz card 29, for additional points to be scored by the player at the end of the game, when a point system is in force. Answers 39 to the quiz questions 46 are provided on the quiz point card 32, as shown in FIG. 8.

Each of the players of the game goes through the exact same procedure described above until one of the players is out of playing cards, thus ending the game. When the entire master deck has been played, players still play out their cards until one player goes out.

A game becomes blocked when none of the players can make a play on the present face-up top card of the master deck 12. To continue the game to its conclusion, the player who had played the present face-up top card from the master deck is now allowed to play any hand-held or face-up card on the face-up card. Also, when a game becomes blocked, the no border card play on another border card rule no longer applies and an air border card 23 may be played on an ocean border card 21 by only the player who played the last face up card. After the new face-up card is played, the next player must then follow by matching it with a boundary or another border card with the same rules that were in effect prior to the blockage. If the second player cannot play on the top face-up card, the same process is repeated until one of the players is out of cards. Each time the player who played the last face-up card has his next turn, he may play any card to eliminate a blockage. The winner is determined by the player having the most points or by the player going out first.

Although there are several separate games of increasing difficulty in the educational games in accordance with the present invention, the method of playing each game is not affected, only the varying degree of information provided by each game including the map, the hand-held playing cards, and the questions presented in the quiz point deck. Also, as is clear from the above disclosure, the minor political and geographical area may represent a state or a country within the major political and geographical area and the major political and geographical area may represent a country or continent.

I claim:

1. An educational game relating to the identification of minor political and geographical areas within a major political and geographical area, including:

a master deck containing a plurality of minor boundary cards representing minor political and geographical areas within the major political and geographical area, each boundary card having indicia representing a minor political and geographical area and having indicia representing information on political and geographical areas outside and adjacent to the boundary of the minor political and geographical area represented thereon, a plurality of minor and political geographical areas having a capitol, a plurality of boundary border cards representing political and geographical areas outside the major political geographical areas which engage the border of the major political and geographical area, each boundary border card having indicia representing a political and geographical area and having indicia representing minor political and geographical areas adjacent to the boundary of the political and geographical area represented thereon, a plurality of air border cards, and a plurality quiz cards; and a capitol deck containing capitol cards, each capitol card consisting of the name of a minor political and geographical area within the major political and geographical area and the name of the capitol of the minor political and geographical area represented thereon; and a quiz point deck, with each quiz card having indicia in the form of a question that relates to a minor boundary political and geographical area of the major political and geographical area.

2. The educational game in accordance with claim 1 wherein the game includes a map representing the minor political and geographical areas within the major political and geographical area.

3. The educational game in accordance with claim 1 wherein the game includes a sub-division deck containing cards, with each card presenting facts related to a predetermined minor political and geographical area within the major political and geographical area.

4. The educational game in accordance with claim 1 wherein said master deck includes fresh water cards for bodies of water located within-the major political and geographical area.

5. The educational game in accordance with claim 1 further including challenger decks.

6. The educational game in accordance with claim 5 wherein said challenger decks are comprised of a challenger win deck and a challenger lose deck.

7. The educational game in accordance with claim 1 wherein said major political and geographical area is the United States.

8. The educational game in accordance with claim 7 wherein said minor boundary cards of said master deck each represent a state within the United States.

9. The educational game in accordance with claim 8 wherein said sub-division deck containing cards representing each original colony that initially formed the United States.

10. The educational game in accordance with claim 8 wherein said minor state boundary cards of said master deck includes capitol, adjacent states, and adjacent boundary information printed thereon.

11. The educational game in accordance with claim 8 wherein said state boundary cards of said master deck includes abbreviations for the capitol, adjacent states, and adjacent boundary information printed thereon.

12. The educational game in accordance with claim 8 wherein said state boundary cards of said master deck includes the number of adjacent states and adjacent boundaries relating to the particular state boundary card.

13. An educational game relating to the identification of minor political and geographical areas within a major political and geographical area, including:

a master deck containing minor boundary cards representing minor political and geographical areas within the major political and geographical area, each minor boundary card having indicia representing a minor political and geographical area and having indicia representing information on political and geographical areas outside and adjacent to the boundary of the minor political and geographical area represented thereon, a plurality of minor and political geographical areas having a capitol, a plurality of boundary border cards representing political and geographical areas outside the major political geographical areas which engage the border of the major political and geographical area, each boundary border card having indicia representing a political and geographical area and having indicia representing minor political and geographical areas adjacent to the boundary of the political and geographical area represented thereon, a plurality of air border cards, and quiz cards each air border card containing indicia thereon to designate the same; and a plurality of a quiz point deck, with each quiz card having indicia in the form of a question that relates to a minor boundary political and geographical area of the major political and geographical area.

14. The educational game in accordance with claim 13 wherein the game includes a map representing the minor political and geographical areas within the major political and geographical area.

15. The educational game in accordance with claim 13 wherein the game includes a sub-division deck containing cards, with each card presenting facts related to a predetermined minor political and geographical area within the major political and geographical area.

16. The educational game in accordance with claim 15 wherein said sub-division deck represents the countries located on the Equator.

17. The educational game in accordance with claim 13 wherein the game includes a capitol deck containing capitol cards, with each card containing the capitol of one of the minor boundary cards within the major and geographical area.

18. The educational game in accordance with claim 13 wherein said master deck includes fresh water cards for bodies of water located within the major political and geographical area.

19. The educational game in accordance with claim 13 further including challenger decks.

20. The educational game in accordance with claim 13 wherein said challenger decks are comprised of a challenger win deck and a challenger lose deck.

21. The educational game in accordance with claim 13 wherein said major political and geographical is a continent, selected from the group comprising, North America, South America, Africa Europe and Asia.

22. The educational game in accordance with claim 21 wherein said country boundary cards of said master deck includes capitol, adjacent states, and adjacent boundary information printed thereon.

23. The educational game in accordance with claim 21 wherein said country boundary cards of said master deck includes abbreviations for capitol, adjacent boundary information printed thereon.

24. The educational game in accordance with claim 21 wherein said country boundary cards of said master deck includes the number of adjacent states and adjacent boundaries relating to the particular state boundary card.

25. The educational game in accordance with claim 13 wherein said minor boundary cards of said master deck represent a country within the selected continent.

* * * * *

UNITED STATES PATENT AND TRADEMARK OFFICE

CERTIFICATE OF CORRECTION

PATENT NO. : 5,690,336

DATED : November 25, 1997

INVENTOR(S) : Matilda Joanne Oliver

It is certified that error appears in the above-indentified patent and that said Letters Patent is hereby corrected as shown below:

IN THE CLAIMS:

| Column | Lines | |
|---|---|---|
| 12 | 17 | after a plurality insert - of -; |
| 12 | 18 | after containing insert - a plurality of -; |
| 13 | 4 | after containing insert - a plurality of -; |
| 13 | 22 | insert - each air border card containing indicia thereon to designate the same - after card and before and |
| 13 | 22 | insert after and and before quiz - a plurality of -; |

Signed and Sealed this

Twenty-first Day of April, 1998

Bruce Lehman

*Attest:*

BRUCE LEHMAN

*Attesting Officer*

*Commissioner of Patents and Trademarks*